US011225966B2

(12) United States Patent
Moon et al.

(10) Patent No.: US 11,225,966 B2
(45) Date of Patent: Jan. 18, 2022

(54) SCROLL COMPRESSOR INCLUDING A BUFFER MEMBER BETWEEN A SHAFT AND A RECESS PART OF AN ECCENTRIC BUSH

(71) Applicant: Hanon Systems, Daejeon (KR)

(72) Inventors: Chi Myeong Moon, Daejeon (KR); Chang Eon Park, Daejeon (KR); Hyun Seong Ahn, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 66 days.

(21) Appl. No.: 16/821,079

(22) Filed: Mar. 17, 2020

(65) Prior Publication Data

US 2020/0300242 A1 Sep. 24, 2020

(30) Foreign Application Priority Data

Mar. 21, 2019 (KR) ..... 10-2019-0032429

(51) Int. Cl.
*F03C 2/00* (2006.01)
*F03C 4/00* (2006.01)
(Continued)

(52) U.S. Cl.
CPC ..... *F04C 15/0065* (2013.01); *F04C 2/025* (2013.01); *F04C 18/0215* (2013.01);
(Continued)

(58) Field of Classification Search
CPC .. F04C 18/0215; F04C 18/063; F04C 27/006; F04C 2240/60; F04C 2240/605; F04C 2240/807; F04C 2270/12; F04C 2270/13; F04C 2270/701; F04C 29/00; F04C 29/0021; F04C 29/0057; F04C 29/0071;
(Continued)

(56) References Cited

U.S. PATENT DOCUMENTS 5,575,635 A * 11/1996 Yamamoto ..... F04C 29/0057 418/55.5
10,309,403 B2 6/2019 Hwang et al.
(Continued)

FOREIGN PATENT DOCUMENTS

DE 19910460 A1 9/2000
EP 3159544 A1 4/2017
(Continued)

*Primary Examiner* — Theresa Trieu
(74) *Attorney, Agent, or Firm* — Shumaker, Loop & Kendrick, LLP; James D. Miller

(57) ABSTRACT

A scroll compressor includes a shaft being rotated by a drive source, an eccentric bush including a recess part into which the shaft is inserted and an eccentric part being eccentric to the shaft, an orbiting scroll configured to perform an orbiting motion in interlock with the eccentric part, a fixed scroll tooth-engaged with the orbiting scroll, and a buffer member configured to prevent an outer periphery of the shaft and an inner periphery of the recess part from coming in contact with each other, wherein the buffer member is formed to be able to perform a relative motion with respect to the shaft and the recess part. Accordingly, the scrolls are prevented from being damaged, an impact sound is prevented from being generated, and an increase of an inertial force and an unbalance force of a rotating body is suppressed.

10 Claims, 16 Drawing Sheets

(51) Int. Cl.

| | |
|---|---|
| ***F04C 2/00*** | (2006.01) |
| ***F04C 18/02*** | (2006.01) |
| ***F04C 15/00*** | (2006.01) |
| ***F04C 2/02*** | (2006.01) |
| ***F04C 29/00*** | (2006.01) |
| ***F04C 29/06*** | (2006.01) |

(52) U.S. Cl.
CPC ..... *F04C 29/0071* (2013.01); *F04C 29/063* (2013.01); *F04C 2240/605* (2013.01); *F05B 2260/96* (2013.01); *F05C 2225/00* (2013.01); *F05C 2251/02* (2013.01); *F05C 2251/10* (2013.01)

(58) Field of Classification Search
CPC ..... F04C 29/06; F04C 29/063; F04C 29/065; F05B 2260/96; F05C 2250/00; F05C 2251/02; F05C 2251/10
See application file for complete search history.

(56) References Cited

U.S. PATENT DOCUMENTS

| | | | | |
|---|---|---|---|---|
| 2002/0098102 | A1* | 7/2002 | Gennami | F04C 18/0215 418/55.4 |
| 2014/0255231 | A1* | 9/2014 | Kii | F04C 29/0057 418/55.5 |
| 2015/0010417 | A1* | 1/2015 | Won | F04C 29/0057 418/55.5 |
| 2015/0093276 | A1* | 4/2015 | Kanemoto | F04C 29/0057 418/55.5 |
| 2015/0198161 | A1 | 7/2015 | Tozawa et al. | |

FOREIGN PATENT DOCUMENTS

| | | | |
|---|---|---|---|
| JP | H10238485 | A | 9/1998 |
| JP | 2010150944 | A | 7/2010 |
| KR | 101581532 | B1 | 12/2015 |

* cited by examiner

SCROLL COMPRESSOR INCLUDING A BUFFER MEMBER BETWEEN A SHAFT AND A RECESS PART OF AN ECCENTRIC BUSH

CROSS-REFERENCE TO RELATED APPLICATION(S)

This patent application claims priority to Korean Patent Application No. 10-2019-0032429 filed on Mar. 21, 2019, the entire disclosure of which is hereby incorporated herein by reference.

FIELD

Exemplary embodiments of the present disclosure relate to a scroll compressor, and more particularly, to a scroll compressor capable of compressing a refrigerant through a fixed scroll and an orbiting scroll.

BACKGROUND

In general, an air conditioner (A/C) for indoor cooling/heating is installed in a vehicle. Such an air conditioner includes a compressor that compresses a low-temperature low-pressure gaseous refrigerant input from an evaporator into a high-temperature high-pressure gaseous refrigerant and sends the compressed refrigerant to a condenser as a configuration of a cooling system.

The compressor is classified into a reciprocating type that compresses the refrigerant in accordance with a reciprocating operation of a piston and a rotary type that performs compression while performing a rotating operation. The reciprocating type is classified into a crank type that transfers the refrigerant to a plurality of pistons using a crank in accordance with a transfer method of a drive source and a swash plate type that transfers the refrigerant to a shaft on which a swash plate is installed. The rotary type is classified into a vain rotary type that uses a rotating rotary shaft and a vane and a scroll type that uses an orbiting scroll and a fixed scroll.

A scroll compressor has the advantages of being capable of obtaining a relatively high compression ratio in comparison with other kinds of compressors and a stable torque through a smooth connection of intake, compression, and discharge strokes of the refrigerant, and thus has been widely used for the refrigerant compression in an air conditioning device.

FIG. 1 is a cross-sectional view illustrating a scroll compressor in the related art, FIG. 2 is an exploded perspective view illustrating a shaft and an eccentric bush in the scroll compressor of FIG. 1, FIG. 3 is a cross-sectional view illustrating the positional relationship between a shaft and an eccentric bush when the scroll compressor of FIG. 1 performs a normal operation, FIG. 4 is a cross-sectional view illustrating a rotated state of the eccentric bush of FIG. 3 based on the shaft due to a rotational clearance, and FIG. 5 is a cross-sectional view illustrating a state where the eccentric bush of FIG. 4 is further rotated based on the shaft due to the rotational clearance.

Referring to the accompanying FIGS. 1 and 2, a scroll compressor in the related art includes a drive source 200 generating a rotating force, a shaft 300 rotated by the drive source 200, an eccentric bush 400 having a recess part 410 into which one end portion 310 of the shaft 300 is inserted and an eccentric part 420 being eccentric to the shaft 300, an orbiting scroll 500 communicating with the eccentric part 420 and performing an orbiting motion, and a fixed scroll 600 forming a compression chamber with the orbiting scroll 500.

Here, for example, in order to prevent the orbiting scroll 500 and the fixed scroll 600 from being damaged due to the compression of a liquid refrigerant during an initial driving of the scroll compressor, the eccentric bush 400 is formed to make the rotational clearance exist between an inner periphery 412 of the recess part 410 and the one end portion 310 of the shaft 300. That is, the eccentric bush 400 is formed to buffer and transfer the rotating motion of the shaft 300 in accordance with the designed rotational clearance without immediately transferring the rotating motion of the shaft 300 to the eccentric bush 400. Accordingly, during the normal operation of the scroll compressor, the eccentric bush 400 is rotated together with the shaft 300 in a state where the recess part 410 and the shaft 300 are concentric to each other as illustrated in FIG. 3, whereas, for example, during the initial driving of the scroll compressor, the eccentric bush 400 is rotated relative to the shaft 300, and thus is rotated together with the shaft 300 in a state where an orbiting radius of the eccentric part 420 has been adjusted as illustrated in FIG. 4.

However, according to the scroll compressor in the related art, for example, if a compression reaction force is increased, or if the rotating speed of the shaft 300 is reduced or the rotation of the shaft 300 is interrupted, the eccentric bush 400 strikes a blow at the shaft 300 due to the rotational clearance as illustrated in FIG. 5, and thus an impact sound is generated to cause the problem that a noise and vibration of the compressor grow worse.

On the other hand, Korean Registered Patent Publication No. 10-1581532 discloses a buffer member provided between a shaft and an eccentric bush to reduce an impact sound caused by a rotational clearance. However, such a buffer member in the related art is fixed to any one of the shaft and the eccentric bush to increase an inertial force of a rotating body, and thus a power being consumed for driving is increased to deteriorate the efficiency. Further, due to an increase of an unbalance force, a noise and vibration of a compressor grow worse.

SUMMARY OF THE DISCLOSURE

An object of the present disclosure is to provide a scroll compressor capable of preventing an impact sound between a shaft and an eccentric bush from being generated due to a rotational clearance provided between the shaft and the eccentric bush to prevent the damage of a scroll caused by compression of a liquid refrigerant during an initial operation of the compressor.

Another object of the present disclosure is to provide a scroll compressor capable of suppressing an increase of an inertial force and an unbalance force of a rotating body caused by a buffer member that may be included to reduce an impact sound due to a rotational clearance.

Other aspects and advantages of the present disclosure can be understood by the following description, and become apparent with reference to embodiments of the present disclosure. Also, it is obvious to those skilled in the art to which the present disclosure pertains that the aspects and advantages of the present disclosure can be realized by the means as claimed and combinations thereof.

In an aspect of the present disclosure to achieve the above objects, a scroll compressor includes a shaft being rotated by a drive source, an eccentric bush including a recess part into which the shaft is inserted and an eccentric part being eccentric to the shaft, an orbiting scroll configured to perform an orbiting motion in interlock with the eccentric part, a fixed scroll tooth-engaged with the orbiting scroll, and a buffer member configured to prevent an outer periphery of the shaft and an inner periphery of the recess part from coming in contact with each other, wherein the buffer member is formed to be able to perform a relative motion with respect to the shaft and the recess part.

The buffer member may be configured to have a ring shape.

The shaft may include a first region inserted into an inner circumference of the buffer member, and a second region located on an opposite side of the recess part based on the first region, wherein an outer diameter of the first region is configured to be smaller than an outer diameter of the second region, and a stepped portion is formed between the first region and the second region.

An inner diameter of the recess part may be configured to be larger than the outer diameter of the second region.

An inner diameter of the buffer member may be configured to be larger than the outer diameter of the first region and may be configured to be smaller than the outer diameter of the second region.

An outer diameter of the buffer member may be configured to be larger than the outer diameter of the second region and may be configured to be smaller than the inner diameter of the recess part.

A thickness of the buffer member may be configured to be larger than a height of the stepped portion.

A half of a value obtained by subtracting the inner diameter of the buffer member from the outer diameter of the buffer member may be configured to be larger than a half of a value obtained by subtracting the outer diameter of the first region from the outer diameter of the second region.

A thickness of the buffer member may be configured to be larger than a gap between the recess part and the second region.

A half of a value obtained by subtracting the inner diameter of the buffer member from the outer diameter of the buffer member may be configured to be larger than a half of a value obtained by subtracting the outer diameter of the second region from the inner diameter of the recess part.

A length of the buffer member in an axial direction may be configured to be smaller than or equal to a length of the first region in an axial direction.

The buffer member may include a cut portion and may be configured to be segmented at one side on a circumferential direction.

The buffer member may include a circular ring part formed to have a constant curvature radius based on a center of the buffer member, and a bent part formed to be bent from the circular ring part toward the inner periphery of the recess part.

The buffer member may include a concave part formed to be bent toward the outer periphery of the shaft part, and a convex part formed to be bent toward the inner periphery of the recess part.

A thickness of the buffer member in a region adjacent toward the stepped portion may be configured to be greater than a thickness of the buffer member in a region adjacent toward a base of support of the recess part.

The buffer member may include a through-hole penetrating the buffer member in a radius direction of the buffer member.

Because the scroll compressor according to the present disclosure includes the shaft being rotated by the drive source, the eccentric bush including the recess part into which the shaft is inserted and the eccentric part being eccentric to the shaft, the orbiting scroll configured to perform the orbiting motion in interlock with the eccentric part, the fixed scroll tooth-engaged with the orbiting scroll, and the buffer member configured to prevent then outer periphery of the shaft and the inner periphery of the recess part from coming in contact with each other, wherein the buffer member is formed to be able to perform the relative motion with respect to the shaft and the recess part, it is possible to prevent the damage of the scroll caused by the compression of the liquid refrigerant during the initial operation of the compressor, and it is possible to prevent the impact sound between the shaft and the eccentric bush from being generated due to the rotational clearance.

Further, it is possible to suppress the increase of the inertial force and the unbalance force of the rotating body caused by the buffer member.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Hereinafter, a scroll compressor according to the present disclosure will be described in detail with reference to accompanying drawings.

Figure 1:
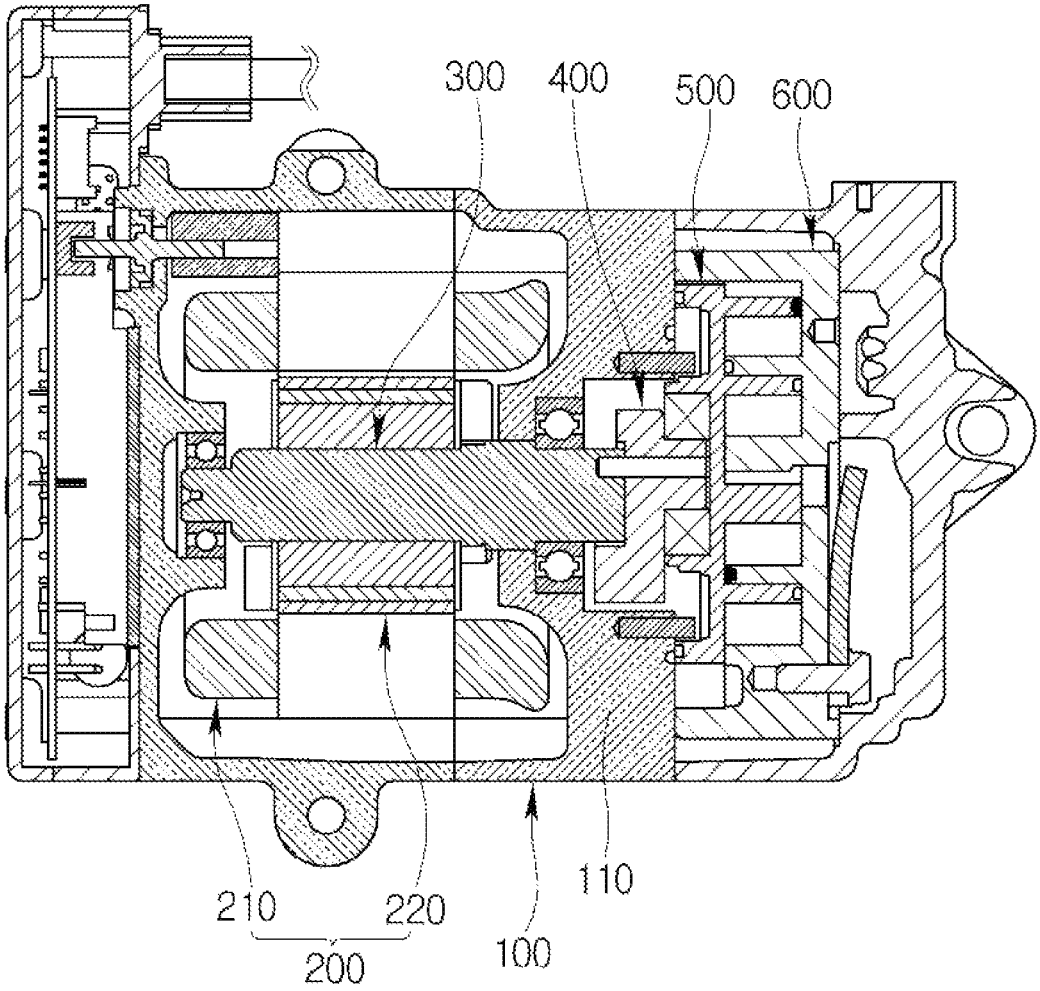
FIG. 1 PRIOR ART
FIG. 1 is a cross-sectional view illustrating a scroll compressor in the related art.
Figure 2:
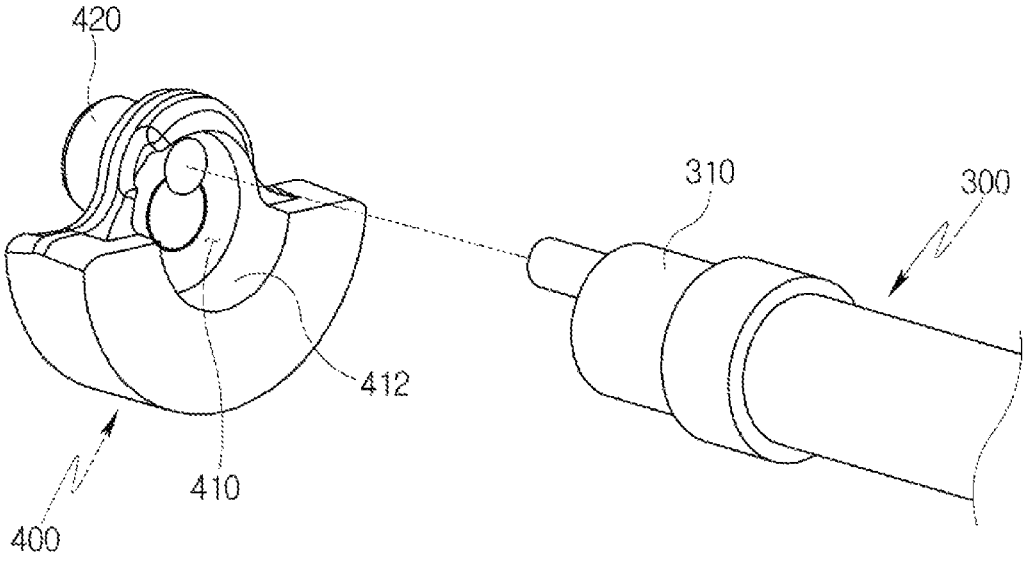
FIG. 2 PRIOR ART
FIG. 2 is an exploded perspective view illustrating a shaft and an eccentric bush in the scroll compressor of FIG. 1.
Figure 3:
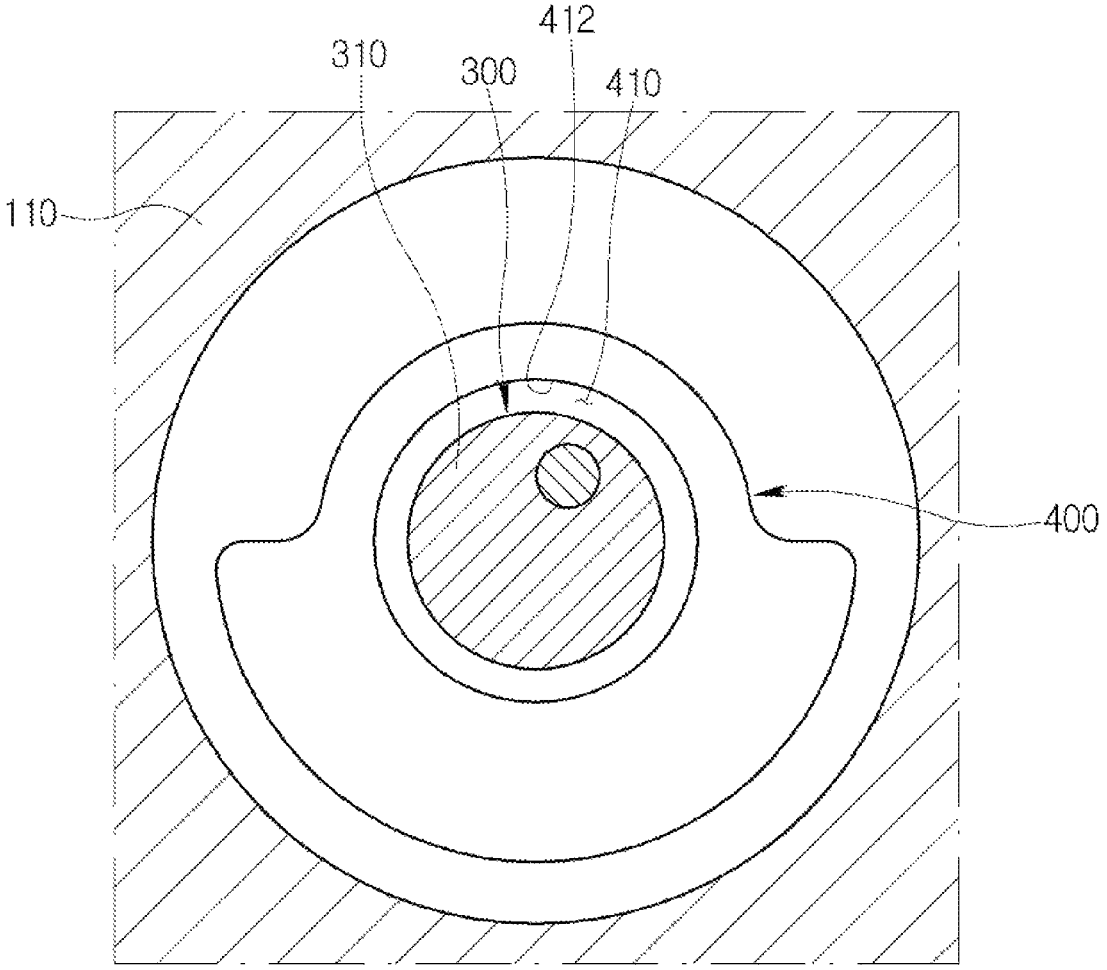
FIG. 3 PRIOR ART
FIG. 3 is a cross-sectional view illustrating the positional relationship between a shaft and an eccentric bush when the scroll compressor of FIG. 1 performs a normal operation.
Figure 4:
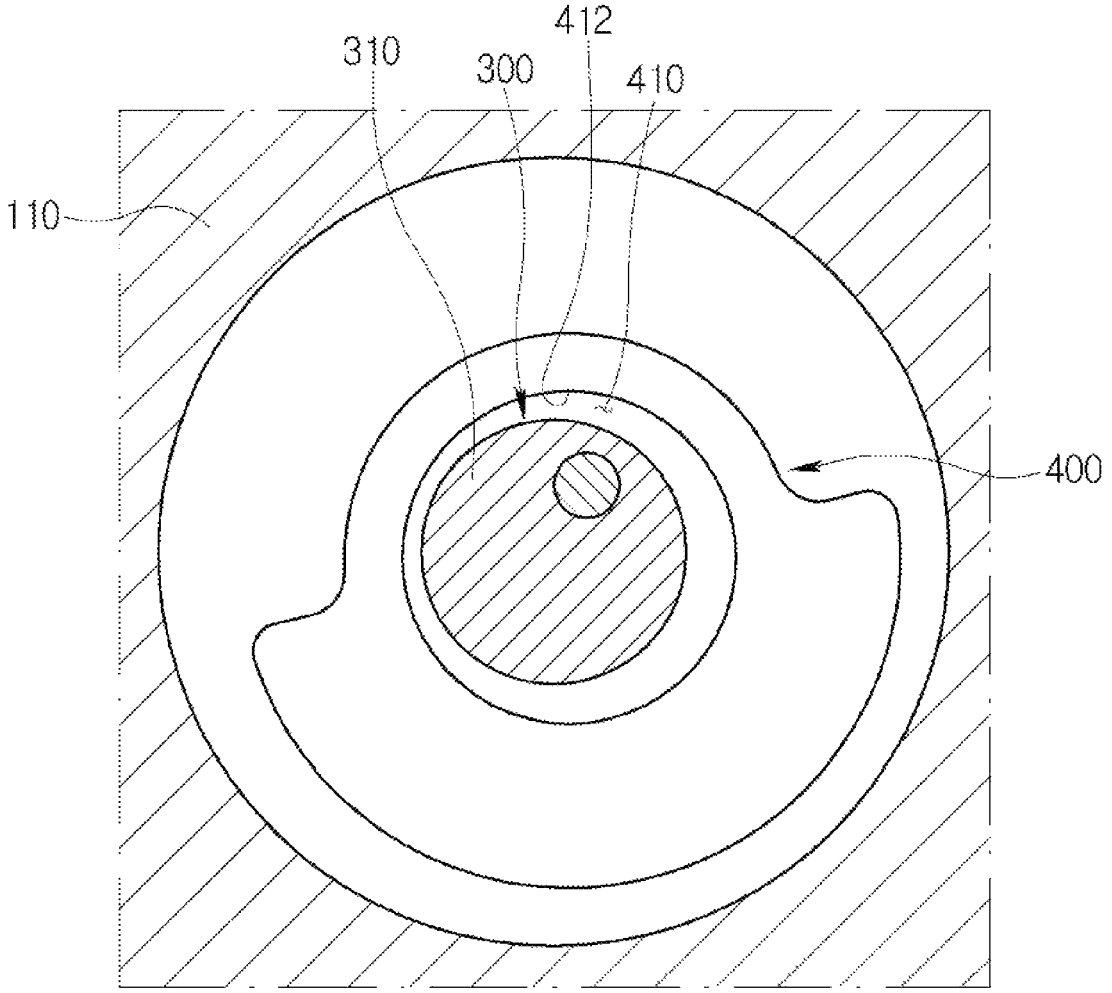
FIG. 4 PRIOR ART
FIG. 4 is a cross-sectional view illustrating a rotated state of the eccentric bush of FIG. 3 based on the shaft caused by a rotational clearance.
Figure 5:
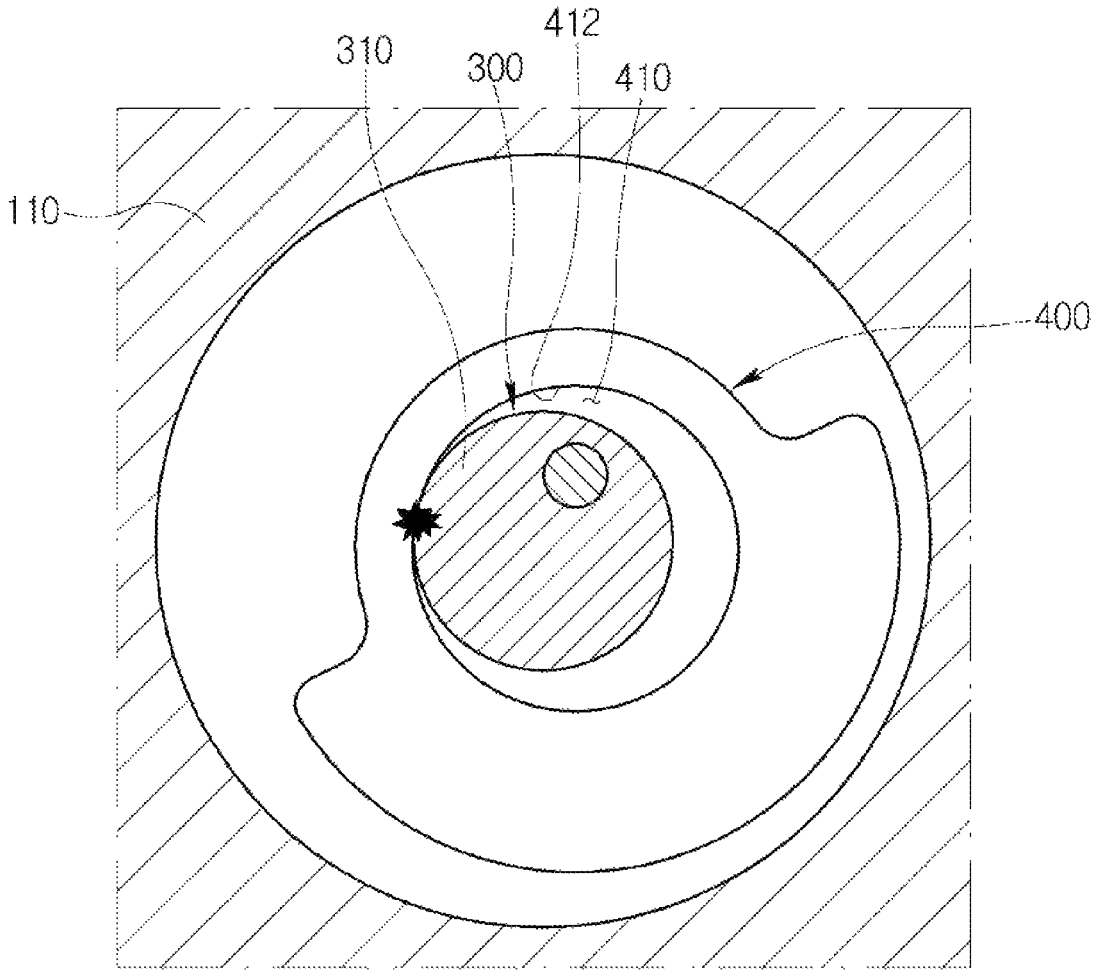
FIG. 5 PRIOR ART
FIG. 5 is a cross-sectional view illustrating a state where the eccentric bush of FIG. 4 is further rotated based on the shaft caused by the rotational clearance.
Figure 6:
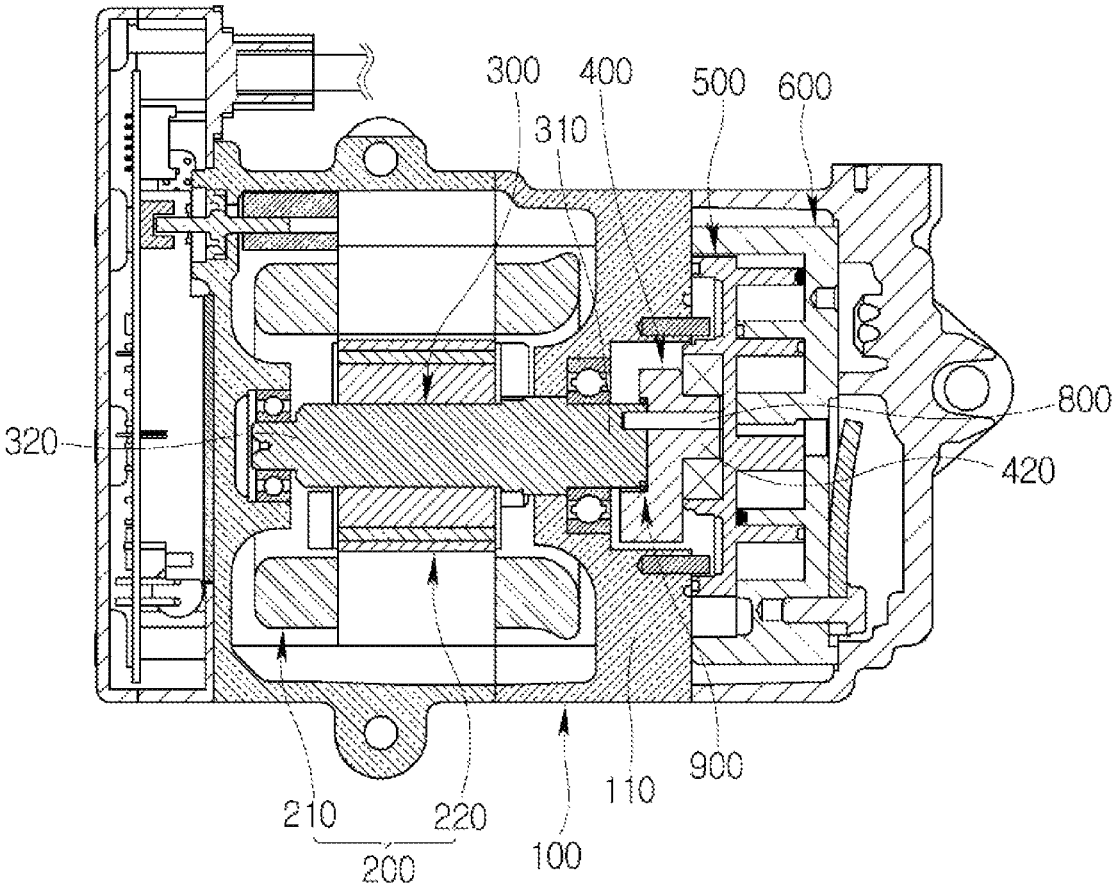
FIG. 6 is a cross-sectional view illustrating a scroll compressor according to an embodiment of the present disclosure.
Figure 7:
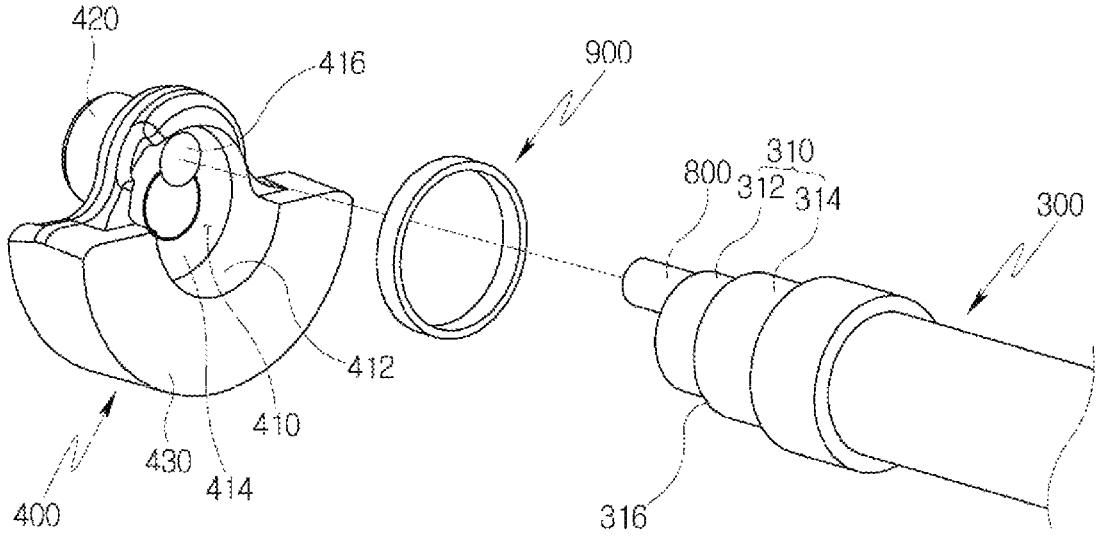
FIG. 7 is an exploded perspective view illustrating a shaft, an eccentric bush, and a buffer member in the scroll compressor of FIG. 6.
Figure 8:
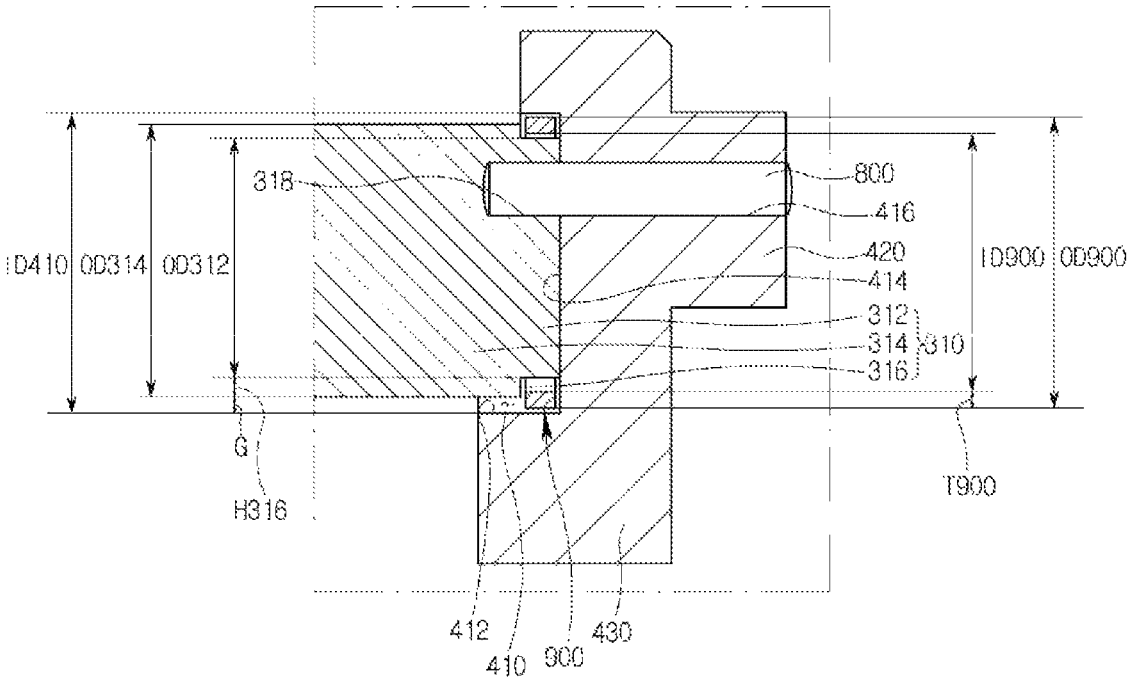
FIG. 8 is an enlarged cross-sectional view illustrating the shaft, the eccentric bush, and the buffer member of FIG. 7 in an assembled state.
Figure 9:
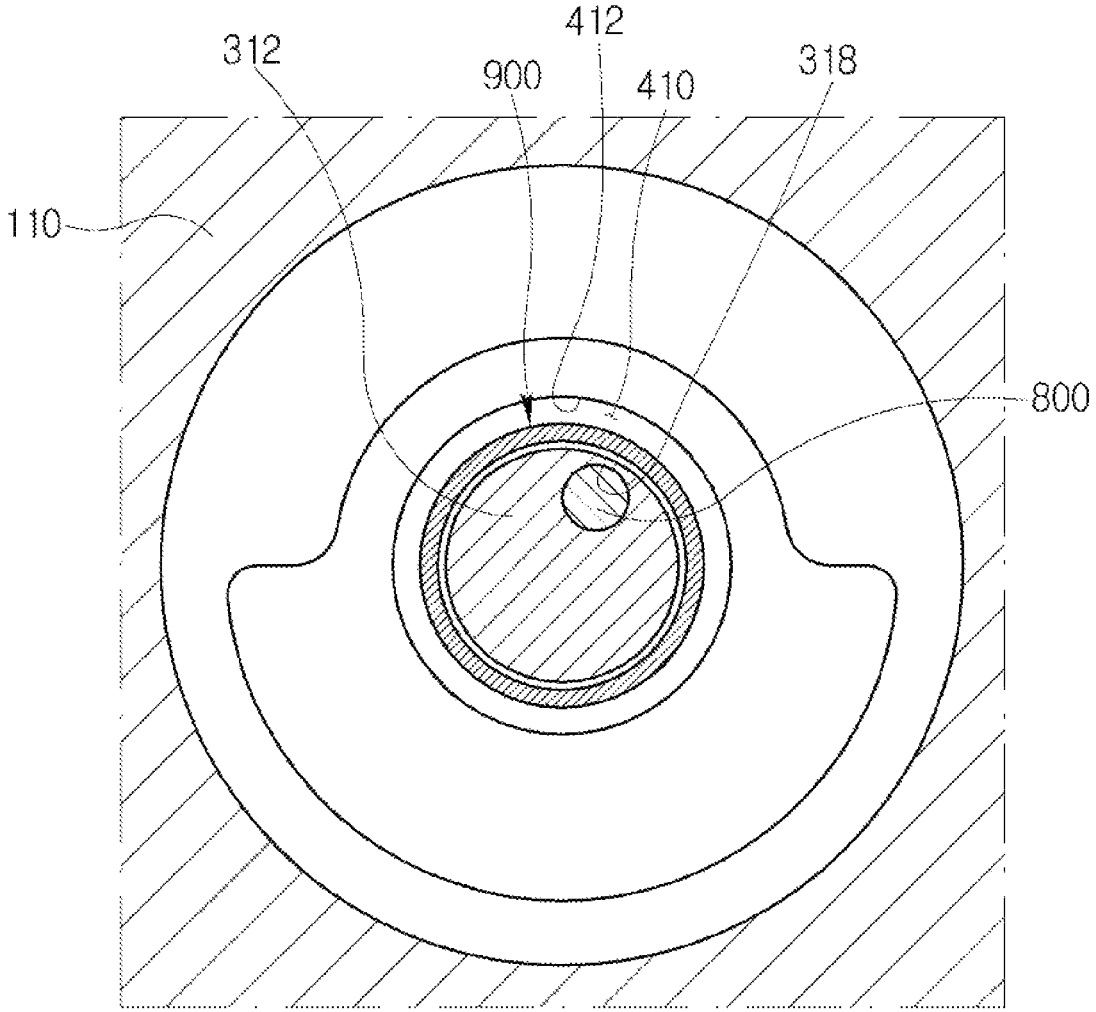
FIG. 9 is a cross-sectional view illustrating the positional relationship between a shaft, an eccentric bush, and a buffer member when the scroll compressor of FIG. 6 performs a normal operation.
Figure 10:
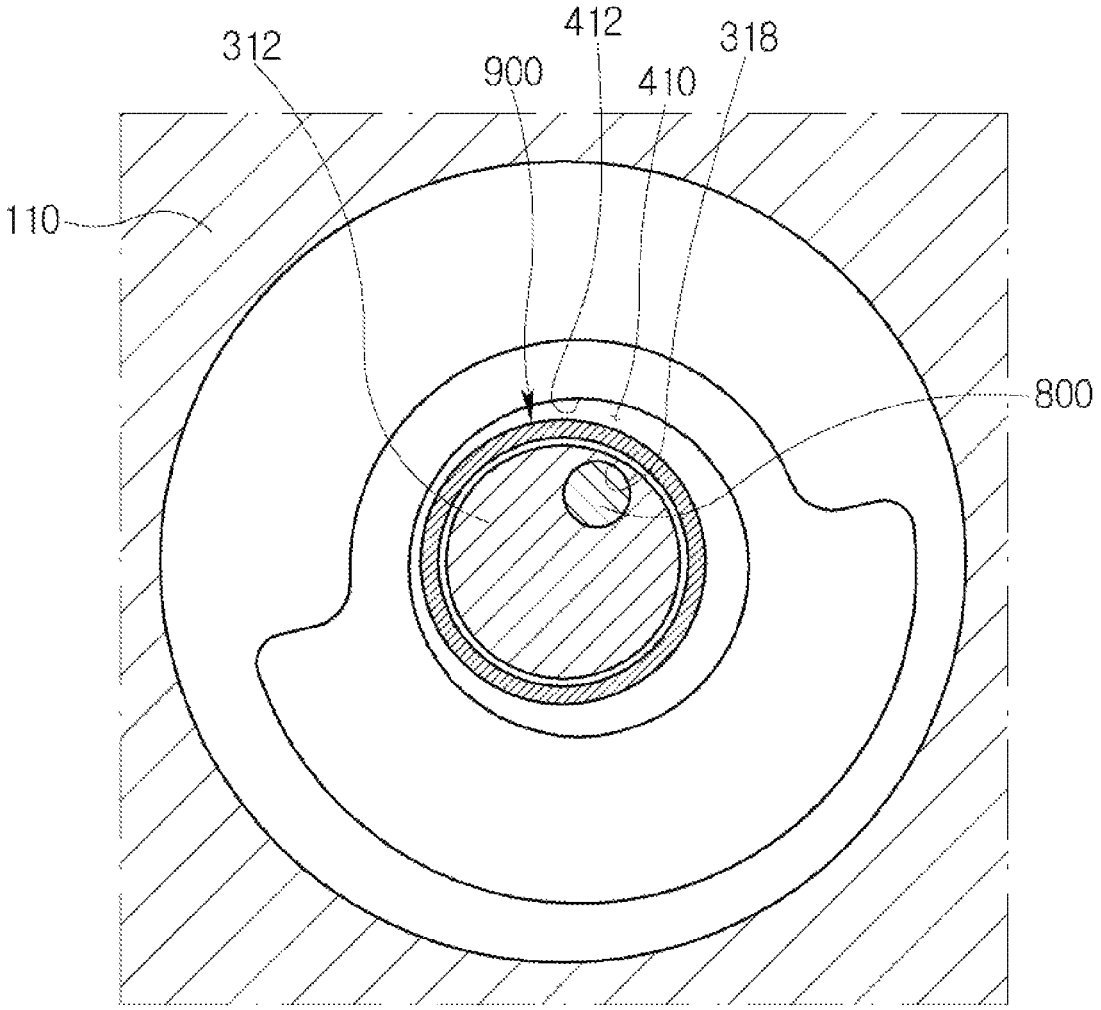
FIG. 10 is a cross-sectional view illustrating a rotated state of the eccentric bush of FIG. 9 based on the shaft caused by a rotational clearance.
Figure 11:
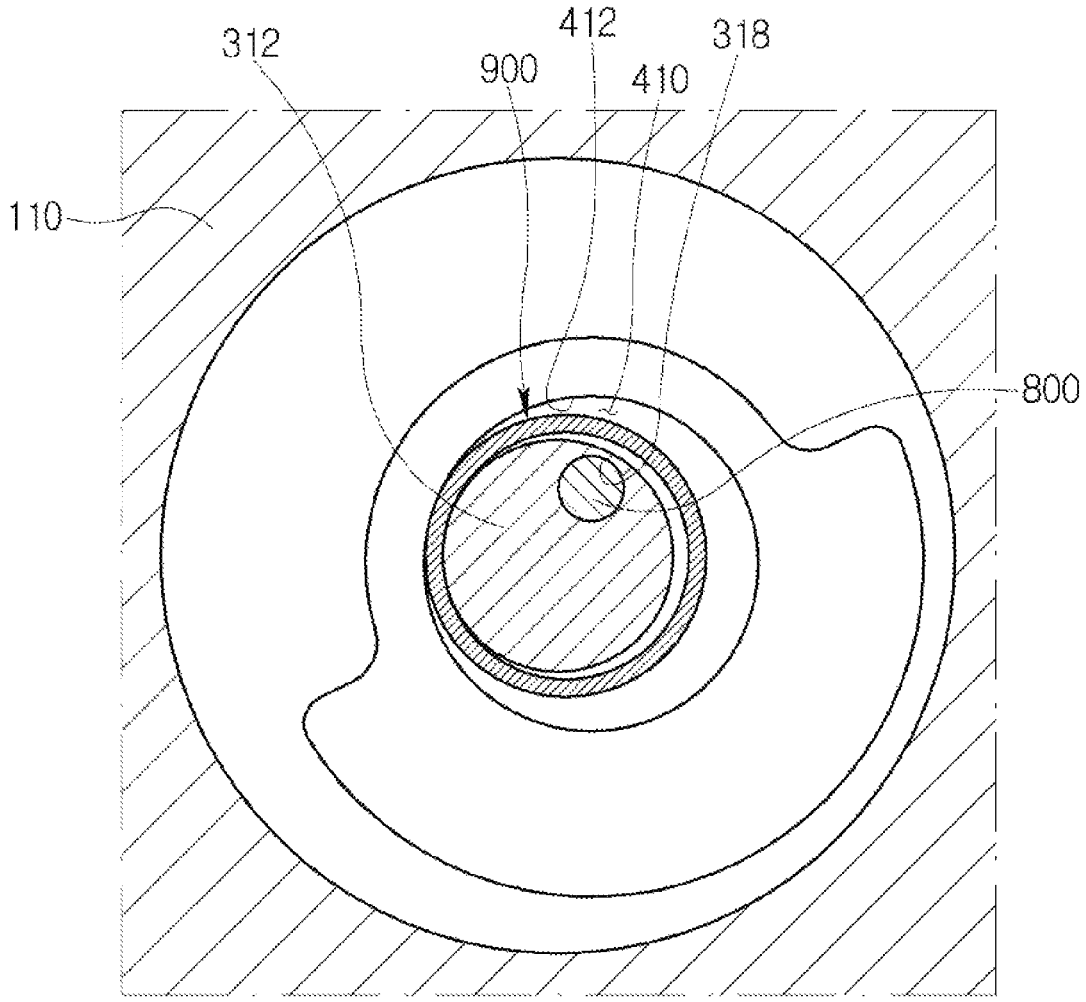
FIG. 11 is a cross-sectional view illustrating a state where the eccentric bush of FIG. 10 is further rotated based on the shaft caused by the rotational clearance.

FIG. 6 is a cross-sectional view illustrating a scroll compressor according to an embodiment of the present disclosure, FIG. 7 is an exploded perspective view illustrating a shaft, an eccentric bush, and a buffer member in the scroll compressor of FIG. 6, and FIG. 8 is an enlarged cross-sectional view illustrating the shaft, the eccentric bush, and the buffer member of FIG. 7 in an assembled state. FIG. 9 is a cross-sectional view illustrating the positional relationship between a shaft, an eccentric bush, and a buffer member when the scroll compressor of FIG. 6 performs a normal operation, FIG. 10 is a cross-sectional view illustrating a rotated state of the eccentric bush of FIG. 9 based on the shaft caused by a rotational clearance, and FIG. 11 is a cross-sectional view illustrating a state where the eccentric bush of FIG. 10 is further rotated based on the shaft caused by the rotational clearance.

Referring to the accompanying FIGS. 6 to 11, a scroll compressor according to an embodiment of the present disclosure may include a casing 100, a drive source 200 provided inside the casing 100 and configured to generate a rotating force, a shaft 300 being rotated by the drive source 200, an eccentric bush 400 configured to convert a rotating motion of the shaft 300 into an eccentric rotating motion, an orbiting scroll 500 configured to perform an orbiting motion in interlock with the eccentric bush 400, and a fixed scroll 600 tooth-engaged with the orbiting scroll 500 and configured to form a compression chamber together with the orbiting scroll 500.

The casing 100 may include a main frame 110 supporting the orbiting scroll 500.

A bearing hole penetrated by the shaft 300 may be formed on the main frame 110.

The drive source 200 may be a motor having a stator 210 and a rotor 220. Here, the drive source 200 may be a disk hub assembly interlocking with an engine of a vehicle.

The shaft 300 may be in the shape of a cylinder extending in one direction, and may have one end portion 310 combined with the eccentric bush 400 and the other end portion 320 combined with the rotor 220.

The eccentric bush 400 may include a recess part 410 into which the one end portion 310 of the shaft 300 is inserted, an eccentric part 420 projecting toward an opposite side of the one end portion 310 of the shaft 300 based on the recess part 410 and being eccentric to the shaft 300, and a balance weight 430 deployed on an opposite side of the eccentric part 420 based on the recess part 410 to keep the overall rotation balance of the eccentric bush 400.

Here, the shaft 300 and the eccentric bush 400 may be formed to make a rotational clearance exist between an inner periphery 412 of the recess part 410 and an outer periphery of the one end portion 310 of the shaft 300 in order to prevent the scrolls from being damaged due to compression of a liquid refrigerant, for example, during an initial driving of the scroll compressor.

That is, the shaft 300 and the eccentric bush 400 may be combined with each other in a relatively rotatable manner based on the location eccentric from a rotational axis of the shaft 300.

Specifically, the one end portion 310 of the shaft 300 may be formed in a cylindrical shape.

Further, in order to prevent the secession of a buffer member 900 to be described later, the one end portion 310 of the shaft 300 may include a first region 312 inserted into an inner circumference of the buffer member 900 to be described later, and a second region 314 located on an opposite side of a base 414 of support of the recess part 410 based on the first region 312. An outer diameter OD312 of the first region 312 may be configured to be smaller than an outer diameter OD314 of the second region 314, and a stepped portion 316 may be formed between the first region 312 and the second region 314.

Further, on a front end surface of the one end portion 310 of the shaft 300, a hinge pin one end portion insertion groove 318 may be formed, into which one end portion of a hinge pin 800 for fastening the shaft 300 and the eccentric bush 400 to each other is inserted.

The hinge pin one end portion insertion groove 318 may be formed in a location where the center of the hinge pin one end portion insertion groove 318 is spaced apart from the rotational axis of the shaft 300 in the radius direction of the shaft 300 so that the central axis of the hinge pin 800 is deployed in the location eccentric to the rotational axis of the shaft 300.

Further, the hinge pin 800 is formed in the shape of a cylinder extending in a direction parallel to an axial direction of the shaft 300, and the hinge pin one end portion insertion groove 318 may be engravedly formed in the shape of a cylinder having an inner diameter that is equal to an outer diameter of the hinge pin 800 to correspond to the hinge pin 800.

The recess part 410 of the eccentric bush 400 may be engravedly formed in the shape of a cylinder to correspond to the one end portion 310 of the shaft 300.

Further, the recess part 410 may be formed so that an inner diameter ID410 of the recess part 410 is configured to be larger than the outer diameter of the one end portion 310 of the shaft 300 (more accurately, the second region 314) so that the eccentric bush 400 is relatively rotatable with respect to the shaft 300 around the hinge pin 800. That is, the gap G between the inner periphery 412 of the recess part 410 and the outer periphery of the one end portion 310 of the shaft 300 (more accurately, second region 314) may be configured to be larger than 0 (zero).

Further, on the base 414 of support of the recess part 410 facing the front end surface of the one end portion 310 of the shaft 300, a hinge pin the other end portion insertion groove 416 may be formed, into which the other end portion of the hinge pin 800 is inserted.

The hinge pin the other end portion insertion groove 416 may be formed in a location where the center of the hinge pin the other end portion insertion groove 416 is spaced apart from the central axis of the recess part 410 in the radius direction of the recess part 410 so that the central axis of the hinge pin 800 is deployed in the location eccentric to the central axis of the recess part 410. Here, it may be preferable that the hinge pin the other end portion insertion groove 416 is formed in the location facing the hinge pin one end portion insertion groove 318 when the recess part 410 is deployed in the location where the recess part 410 becomes concentric with the one end portion 310 of the shaft 300, so that the eccentric bush 400 can perform a relative rotation motion with respect to the shaft 300 in one direction and in the opposite direction.

Further, the hinge pin the other end portion insertion groove 416 may be engravedly formed in the shape of a cylinder having an inner diameter that is equal to the outer diameter of the hinge pin 800 to correspond to the hinge pin 800.

However, according to the scroll compressor according to the present embodiment, for example, in order to prevent the eccentric bush 400 from striking a blow at the shaft 300 due to the rotational clearance and generating an impact sound in the case where a compression reaction force is increased, or in the case where the rotating speed of the shaft 300 is reduced or the rotation of the shaft 300 is interrupted, the buffer member 900, which is formed of materials (e.g., PTFE, plastic, rubber, and the like) having an elastic coefficient and a shore hardness that are lower than those of materials of the shaft 300 and the eccentric bush 400, may be interposed between the one end portion 310 of the shaft 300 and the recess part 410.

The buffer member 900 may be configured to prevent the outer periphery of the one end portion 310 of the shaft 300 and the inner periphery 412 of the recess part 410 from coming in contact with each other.

Specifically, the buffer member 900 may be formed in a circular shape extending along the outer periphery of the first region 312 and the inner periphery 412 of the recess part 410. That is, for example, based on the time when the center of the buffer member 900, the center of the recess part 410, and the center of the first region 312 are concentrically deployed as illustrated in FIG. 9, the buffer member 900 may be formed in the circular shape in which the distance between the buffer member 900 and the inner periphery of the recess part 410 and the distance between the buffer member 900 and the outer periphery of the first region 312 become constant.

Further, the buffer member 900 may be configured so that an outer diameter OD900 of the buffer member 900 is larger than the outer diameter OD314 of the second region 314, so that the outer periphery of the second region 314 first comes in contact with the inner periphery 412 of the recess part 410 before coming in contact with the inner periphery 412 of the recess part 410.

Further, in order to prevent the outer periphery of the second region 314 and the inner periphery 412 of the recess part 410 from coming in contact with each other while the buffer member 900 comes in contact with both the first region 312 and the recess part 410, a thickness T900 of the buffer member 900 ((the outer diameter of the buffer member−the inner diameter of the buffer member)/2) may be configured to be larger than a height H316 of the stepped portion 316 ((the outer diameter of the second region−the inner diameter of the first region)/2).

On the other hand, the buffer member 900 may be configured to be able to perform a relative motion with respect to the shaft 300 and the recess part 410. That is, the buffer member 900 may be configured to be not fixed to both the shaft 300 and the recess part 410.

Specifically, the buffer member 900 may be configured so that an inner diameter ID900 of the buffer member 900 is larger than the outer diameter OD312 of the first region 312, so that the buffer member 900 can perform the relative motion with respect to the first region 312.

Further, the buffer member 900 may be configured so that the outer diameter OD900 of the buffer member 900 is smaller than the inner diameter ID410 of the recess part 410, so that the buffer member 900 can perform the relative motion with respect to the recess part 410.

Further, in order to prevent the buffer member 900 from being sandwiched between the stepped portion 316 and the base 414 of support of the recess part 410, the buffer member 900 may be configured so that a length of the buffer member 900 in an axial direction is smaller than or equal to a length of the first region 312 in an axial direction (the distance from the stepped portion 316 to the front end surface of the first region 312 or the distance from the stepped portion 316 to the base 414 of support of the recess part 410).

Here, the buffer member 900 is not fixed to both the shaft 300 and the recess part 410, and if the thickness T900 of the buffer member 900 is smaller than the gap G between the shaft 300 and the recess part 410, the buffer member 900 may secede through the gap G between the shaft 300 and the recess part 410.

In order to prevent this, in the present embodiment, the one end portion 310 of the shaft 300 may include the first region 312 and the second region 314, the stepped portion 316 may be formed between the first region 312 and the second region 314, and the buffer member 900 may be hindered by the stepped portion 316. That is, the inner diameter ID900 of the buffer member 900 may be configured to be smaller than the outer diameter OD314 of the second region 314. Further, the thickness T900 of the buffer member 900 ((the outer diameter of the buffer member−the inner diameter of the buffer member)/2) may be configured to be larger than the gap G between the recess part 410 and the second region 314 ((the inner diameter of the recess part−the outer diameter of the second region)/2).

Hereinafter, the effects of the scroll compressor according to the present embodiment will be described.

If a power is applied to the drive source 200, the shaft 300 is rotated together with the rotor 220, and the orbiting scroll 500 performs the orbiting motion in interlock with the shaft 300 through the eccentric bush 400. Through the orbiting motion of the orbiting scroll 500, a series of processes may be repeated, in which the refrigerant is sucked into the compression chamber, is compressed in the compression chamber, and then is discharged from the compression chamber.

Here, according to the scroll compressor according to the present embodiment, the rotational clearance is formed between the shaft 300 and the eccentric bush 400, and thus, during the normal operation of the scroll compressor, the eccentric bush 400 may be rotated together with the shaft 300 in a state where the recess part 410 and the shaft 300 are concentric to each other as illustrated in FIG. 9, whereas, for example, if the liquid refrigerant exists, such as during the initial driving of the scroll compressor, the eccentric bush 400 may be rotated relative to the shaft 300, and thus may be rotated together with the shaft 300 in a state where the orbiting radius of the eccentric part 420 has been adjusted as illustrated in FIG. 10. That is, the rotating motion of the shaft 300 may not be immediately transferred to the eccentric bush 400, but may be buffered and transferred to the eccentric bush 400 in accordance with the designed rotational clearance. Accordingly, the scrolls can be prevented from being damaged due to the compression of the liquid refrigerant.

Further, because the buffer member 900 is formed between the shaft 300 and the recess part 410 to prevent the outer periphery of the shaft 300 and the inner periphery 412 of the recess part 410 from coming in contact with each other, the impact sound can be prevented from being generated between the shaft 300 and the eccentric bush 400. That is, if the eccentric bush 400 is further rotated over the state of FIG. 10 with respect to the shaft 300, the buffer member 900 comes in contact with the outer periphery of the first region 312 and the inner periphery 412 of the recess part 410 as illustrated in FIG. 11, and thus the inner periphery 412 of the recess part 410 can be prevented from striking a blow at the outer periphery of the first region 312 and the outer periphery of the second region 314. Accordingly, the impact sound can be prevented from being generated between the shaft 300 and the eccentric bush 400, and thus the noise and the vibration of the compressor can be improved.

Further, because the buffer member 900 is formed of the materials (e.g., PTFE, plastic, rubber, and the like) having the elastic coefficient and the shore hardness that are lower than those of the materials of the shaft 300 and the eccentric bush 400, the noise and the vibration being generated as the buffer member 900 collides with the shaft 300 and the recess part 410 can be reduced, and the buffer member 900, the shaft 300, and the recess part 410 can be prevented from being damaged.

Further, the buffer member 900 may be configured to perform the relative motion with respect to the shaft 300 and the recess part 410, and thus the buffer member 900 may not be fixed to both the shaft 300 and the recess part 410. Accordingly, the inertial force of the rotating body can be prevented from being increased by the buffer member 900, and thus the efficiency can be prevented from deteriorating without increasing the power being consumed for the driving. Further, the noise and the vibration can be prevented from growing worse through prevention of the unbalance force of the rotating body from being increased by the buffer member 900.

Figure 12:
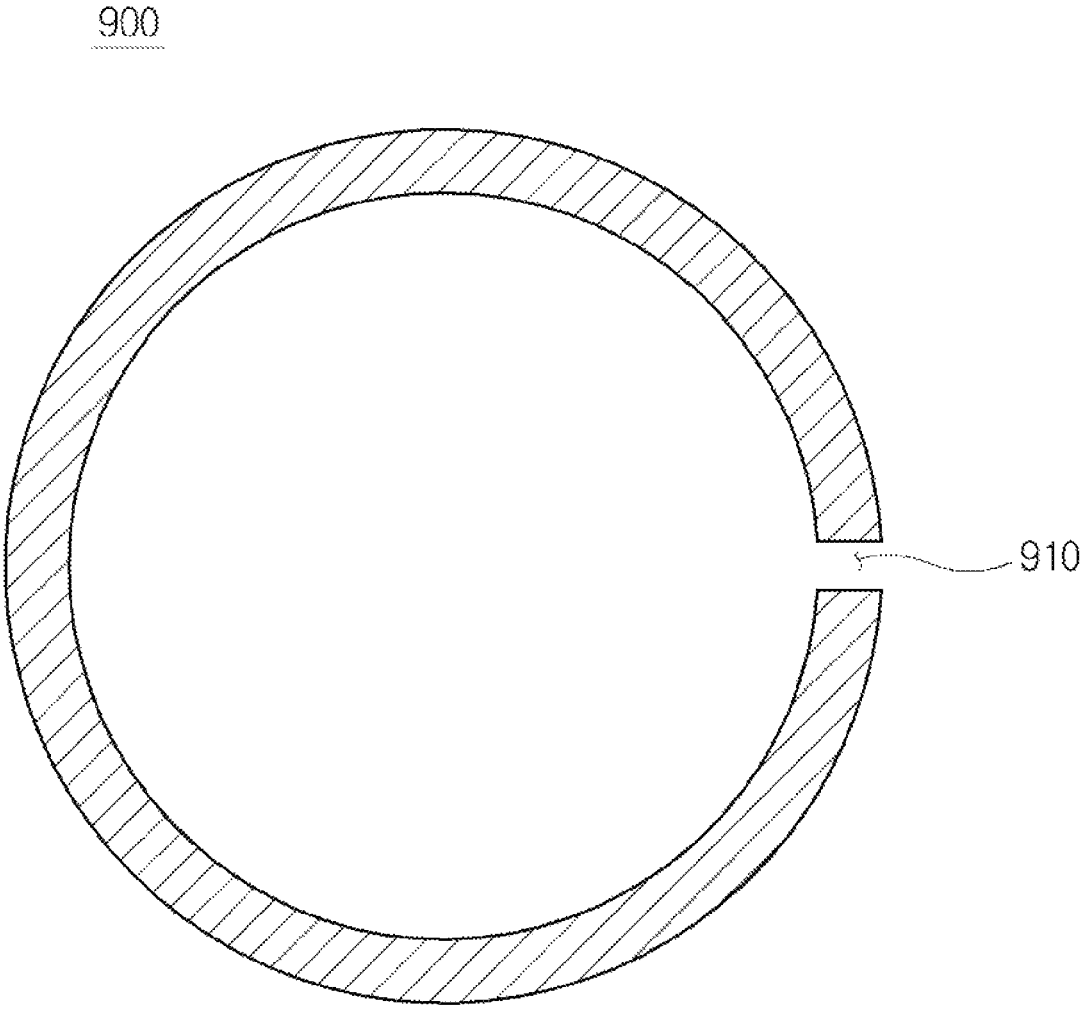
FIG. 12 is a front cross-sectional view illustrating a buffer member in a scroll compressor according to another embodiment of the present disclosure.

On the other hand, in the present embodiment, the buffer member 900 may be continuously formed on the circumferential direction, but as illustrated in FIG. 12, the buffer member 900 may include a cut portion 910 and may be configured to be segmented at one side on the circumferential direction. In this case, assembling of the buffer member 900 can be improved. However, it may be preferable that the width of the cut portion 910 in the circumferential direction is configured to be smaller than or equal to the thickness T900 of the buffer member 900 so that the outer periphery of the first region 312 and the inner periphery of the recess part 410 are prevented from colliding with each other through the cut portion 910.

On the other hand, in the present embodiment, the buffer member 900 is formed in a circular ring shape. That is, based on the time when the center of the buffer member 900, the center of the recess part 410, and the center of the first region 312 are concentrically deployed, the buffer member 900 is formed so that the distance between the buffer member 900 and the inner periphery of the recess part 410 and the distance between the buffer member 900 and the outer periphery of the first region 312 become constant. However, the present disclosure is not limited thereto.

Figure 13:
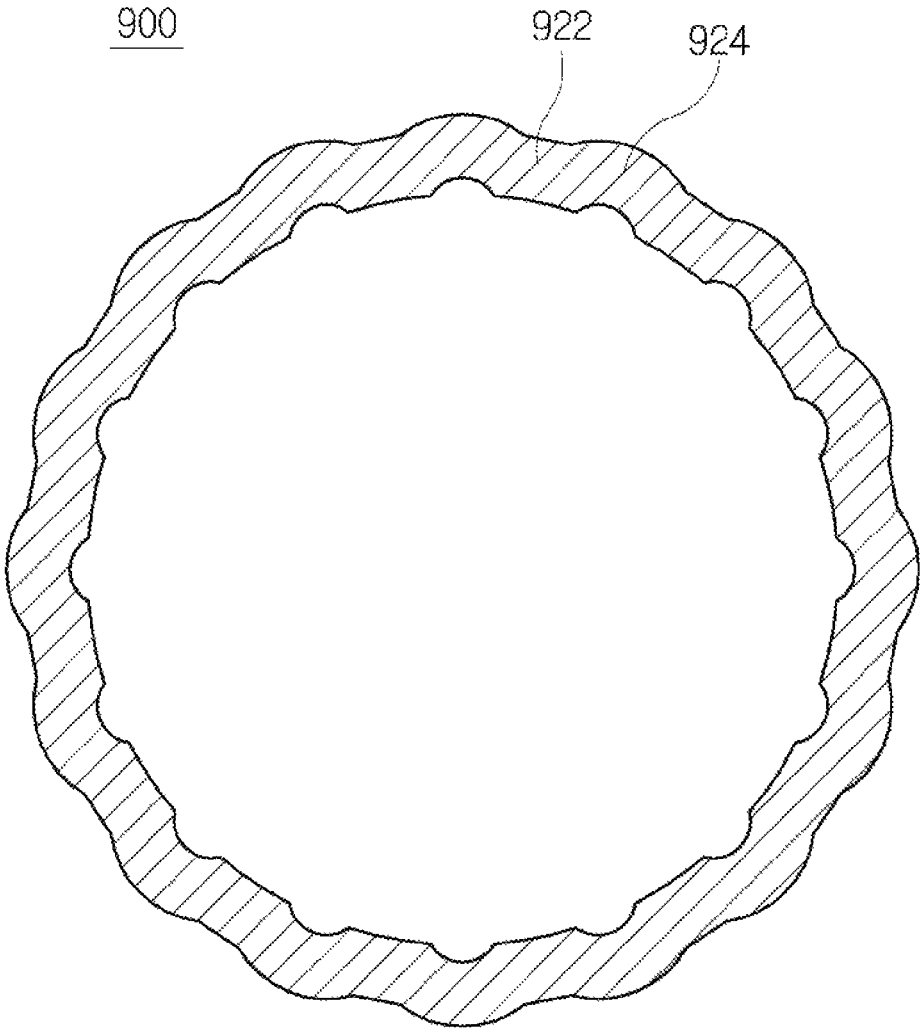
FIG. 13 is a front cross-sectional view illustrating a buffer member in a scroll compressor according to still another embodiment of the present disclosure.

That is, for example, as illustrated in FIG. 13, the buffer member 900 may include a circular ring part 922 formed to have a constant curvature radius based on the center of the buffer member 900, and a bent part 924 formed to be bent from the circular ring part 922 toward the inner periphery of the recess part 410. Here, the outer periphery of the first region 312 may come in contact with the inner periphery of the circular ring part 922, but may not come in contact with the inner periphery of the bent part 924, whereas the inner periphery of the recess part 410 may come in contact with the outer periphery of the bent part 924, but may not come in contact with the outer periphery of the circular ring part 922. In this case, the contact area between the buffer member 900 and the first region 312 and the contact area between the buffer member 900 and the recess part 410 can be reduced, and due to the buffering effect caused by an elastic deformation, the collision noise between the buffer member 900 and the first region 312 and the collision noise between the buffer member 900 and the recess part 410 can be reduced.

Figure 14:
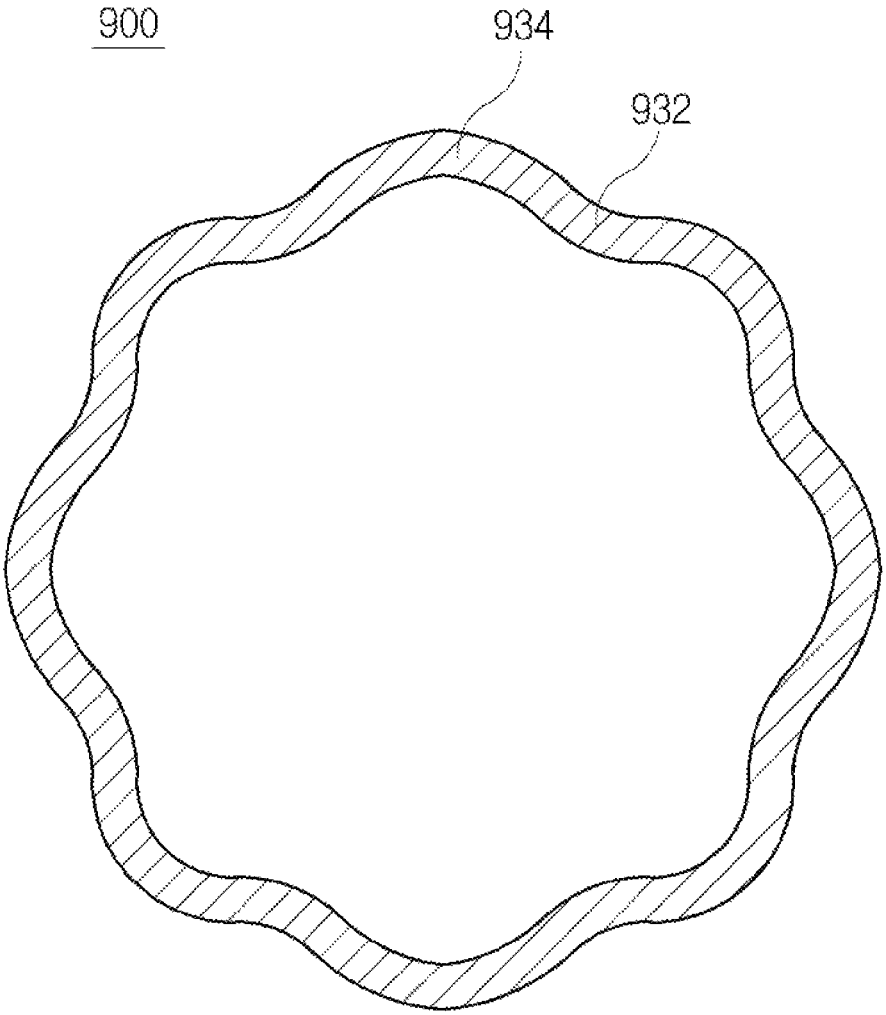
FIG. 14 is a front cross-sectional view illustrating a buffer member in a scroll compressor according to still another embodiment of the present disclosure.

Further, as illustrated in FIG. 14, the buffer member 900 may include a concave part 932 formed to be bent toward the outer periphery of the first region 312, and a convex part 934 formed to be bent toward the inner periphery of the recess part 410, and the concave part 932 and the convex part 934 may be alternatively formed. Here, the outer periphery of the first region 312 may come in contact with the inner periphery of the concave part 932, but may not come in contact with the inner periphery of the convex part 934, whereas the inner periphery of the recess part 410 may come in contact with the outer periphery of the convex part 934, but may not come in contact with the outer periphery of the concave part 932. In this case, the contact area between the buffer member 900 and the first region 312 and the contact area between the buffer member 900 and the recess part 410 can be reduced, and due to the buffering effect caused by the elastic deformation, the collision noise between the buffer member 900 and the first region 312 and the collision noise between the buffer member 900 and the recess part 410 can be further reduced.

Figure 15:
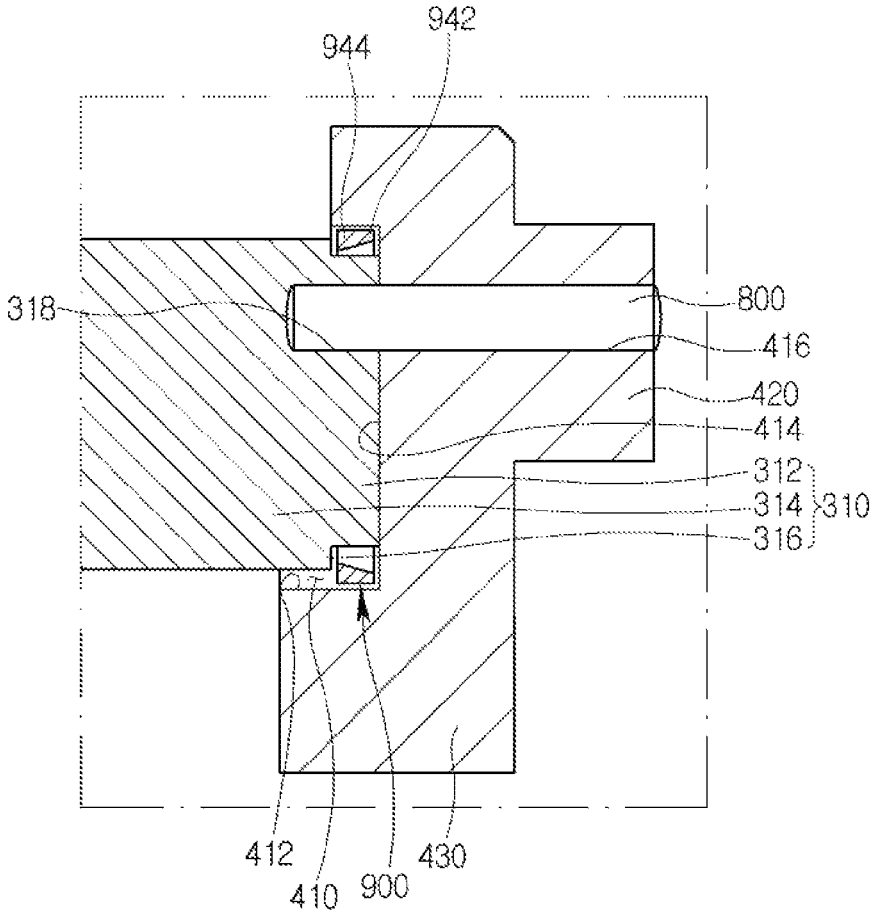
FIG. 15 is a side cross-sectional view illustrating a buffer member in a scroll compressor according to still another embodiment of the present disclosure.
Figure 16:
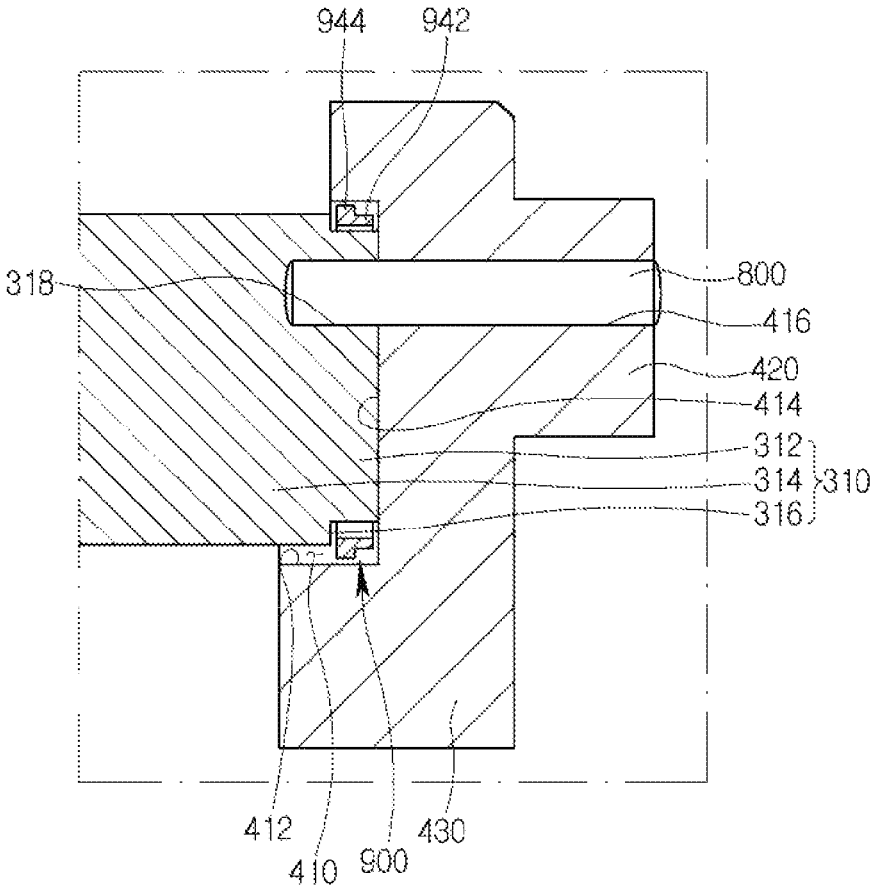
FIG. 16 is a side cross-sectional view illustrating a buffer member in a scroll compressor according to still another embodiment of the present disclosure.

Further, as illustrated in FIG. 15 or 16, the buffer member 900 may be configured so that the thickness of the buffer member 900 in a region 944 adjacent toward the stepped portion 316 is greater than the thickness of the buffer member 900 in a region 942 adjacent toward the base 414 of support of the recess part 410. In this case, the region 944 adjacent toward the stepped portion 316 may come in contact with both the outer periphery of the first region 312 and the inner periphery of the recess part 410, but the region 942 adjacent toward the base 414 of support of the recess part 410 may not come in contact with at least one of the outer periphery of the first region 312 and the inner periphery of the recess part 410. Accordingly, the contact area of the buffer member 900 may be reduced, and thus the collision noise of the buffer member 900 may be reduced. Further, in this case, because the region 944 adjacent toward the stepped portion 316 is formed with a great thickness, the buffer member 900 can be prevented from seceding through the gap G between the shaft 300 and the recess part 410 more effectively.

Figure 17:
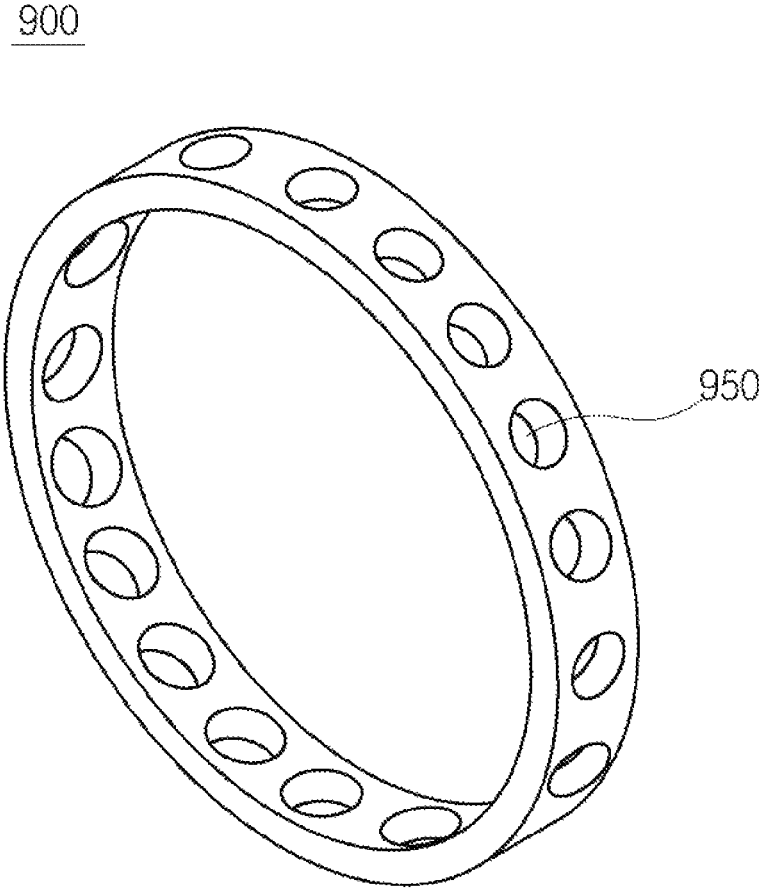
FIG. 17 is a perspective view illustrating a buffer member in a scroll compressor according to still another embodiment of the present disclosure.

On the other hand, as illustrated in FIG. 17, the buffer member 900 may include a through-hole 950 penetrating the buffer member 900 in a radius direction of the buffer member 900. In this case, not only the contact area and the collision noise of the buffer member 900 can be reduced but also the weight of the buffer member 900 can be reduced.

Although preferred embodiments of the present disclosure have been described for illustrative purposes, the present disclosure is not limited by them, and those of ordinary skill in the art will appreciate that various modifications, additions and substitutions are possible, without departing from the scope and spirit of the disclosure as disclosed in the accompanying claims.

What is claimed is:

1. A scroll compressor comprising:

a shaft being rotated by a drive source;

an eccentric bush including a recess part into which the shaft is inserted and an eccentric part being eccentric to the shaft;

an orbiting scroll configured to perform an orbiting motion in interlock with the eccentric part;

a fixed scroll tooth-engaged with the orbiting scroll; and a buffer member configured to prevent an outer periphery of the shaft and an inner periphery of the recess part from coming in contact with each other, wherein the buffer member is formed to be able to perform a relative motion with respect to the shaft and the recess part, wherein the buffer member is configured to have a ring shape, wherein the shaft further comprises a first region inserted into an inner circumference of the buffer member; and a second region located on an opposite side of the recess part based on the first region, wherein an outer diameter of the first region is configured to be smaller than an outer diameter of the second region, and a stepped portion is formed between the first region and the second region, wherein an inner diameter of the recess part is configured to be larger than the outer diameter of the second region, wherein an inner diameter of the buffer member is configured to be larger than the outer diameter of the first region and is configured to be smaller than the outer diameter of the second region, wherein an outer diameter of the buffer member is configured to be larger than the outer diameter of the second region and is configured to be smaller than the inner diameter of the recess part, wherein a thickness of the buffer member is configured to be larger than a gap between the recess part and the second region, and wherein a half of a value obtained by subtracting the inner diameter of the buffer member from the outer diameter of the buffer member is configured to be larger than a half of a value obtained by subtracting the outer diameter of the second region from the inner diameter of the recess part.

2. The scroll compressor of claim 1, wherein a thickness of the buffer member is configured to be larger than a height of the stepped portion.

3. The scroll compressor of claim 2, wherein a half of a value obtained by subtracting the inner diameter of the buffer member from the outer diameter of the buffer member is configured to be larger than a half of a value obtained by subtracting the outer diameter of the first region from the outer diameter of the second region.

4. The scroll compressor of claim 1, wherein a length of the buffer member in an axial direction is configured to be smaller than or equal to a length of the first region in an axial direction.

5. The scroll compressor of claim 1, wherein the buffer member further comprises a cut portion and is configured to be segmented at one side on a circumferential direction.

6. The scroll compressor of claim 1, wherein the buffer member further comprises:

a circular ring part formed to have a constant curvature radius based on a center of the buffer member; and a bent part formed to be bent from the circular ring part toward the inner periphery of the recess part.

7. The scroll compressor of claim 1, wherein the buffer member further comprises:

a concave part formed to be bent toward the outer periphery of the shaft; and a convex part formed to be bent toward the inner periphery of the recess part.

8. The scroll compressor of claim 1, wherein a thickness of the buffer member in a region adjacent toward the stepped portion is configured to be greater than a thickness of the buffer member in a region adjacent toward a base of support of the recess part.

9. The scroll compressor of claim 1, wherein the buffer member comprises a through-hole penetrating the buffer member in a radius direction of the buffer member.

10. A scroll compressor comprising:

a shaft being rotated by a drive source;

an eccentric bush including a recess part into which the shaft is inserted and an eccentric part being eccentric to the shaft;

an orbiting scroll configured to perform an orbiting motion in interlock with the eccentric part;

a fixed scroll tooth-engaged with the orbiting scroll; and a buffer member configured to prevent an outer periphery of the shaft and an inner periphery of the recess part from coming in contact with each other, wherein the buffer member is formed to be able to perform a relative motion with respect to the shaft and the recess part, wherein the buffer member is configured to have a ring shape, wherein the shaft further comprises a first region inserted into an inner circumference of the buffer member; and a second region located on an opposite side of the recess part based on the first region, wherein an outer diameter of the first region is configured to be smaller than an outer diameter of the second region, and a stepped portion is formed between the first region and the second region, wherein an inner diameter of the recess part is configured to be larger than the outer diameter of the second region, wherein an inner diameter of the buffer member is configured to be larger than the outer diameter of the first region and is configured to be smaller than the outer diameter of the second region, wherein an outer diameter of the buffer member is configured to be larger than the outer diameter of the second region and is configured to be smaller than the inner diameter of the recess part, wherein a thickness of the buffer member is configured to be larger than a height of the stepped portion, and wherein a half of a value obtained by subtracting the inner diameter of the buffer member from the outer diameter of the buffer member is configured to be larger than a half of a value obtained by subtracting the outer diameter of the first region from the outer diameter of the second region.

* * * * *